US008814110B2

(12) United States Patent
Crager et al.

(10) Patent No.: US 8,814,110 B2
(45) Date of Patent: Aug. 26, 2014

(54) MODULAR TANK STAND

(75) Inventors: David L. Crager, Auburn, IN (US); Douglas J. Murphy, Marshall, TX (US)

(73) Assignee: ROTO Engineering GmbH i.G., Frankfurt am Main (DE)

( * ) Notice: Subject to any disclaimer, the term of this patent is extended or adjusted under 35 U.S.C. 154(b) by 284 days.

(21) Appl. No.: 13/034,908

(22) Filed: Feb. 25, 2011

(65) Prior Publication Data

US 2011/0240806 A1 Oct. 6, 2011

Related U.S. Application Data

(60) Provisional application No. 61/309,243, filed on Mar. 1, 2010.

(51) Int. Cl.
*A47G 23/02* (2006.01)
*B65D 19/00* (2006.01)

(52) U.S. Cl.
CPC ..... *B65D 19/0002* (2013.01)
USPC ..... 248/146; 108/57.26; 108/64; 206/524.6

(58) Field of Classification Search
USPC ..... 248/146; 108/57.26, 64, 56.1; 206/524.6; 264/259
See application file for complete search history.

(56) References Cited

U.S. PATENT DOCUMENTS 3,131,829 A 5/1964 Masser
3,470,656 A 10/1969 Clements
3,541,977 A * 11/1970 Waldman ..... 108/53.1
3,650,224 A 3/1972 Petix et al.
3,683,825 A 8/1972 Sheldon
3,753,407 A * 8/1973 Tilseth ..... 108/53.3
3,819,138 A 6/1974 Rehkopf et al.
4,008,669 A * 2/1977 Sumrell ..... 410/47
4,051,787 A 10/1977 Nichitani et al.
4,660,733 A 4/1987 Snyder et al.
4,693,386 A 9/1987 Hughes et al.
4,829,909 A * 5/1989 Mandel ..... 108/55.5

(Continued)

FOREIGN PATENT DOCUMENTS

CH 685276 5/1995
CN 201822558 U * 10/2010 ..... A47G 27/02

(Continued)

OTHER PUBLICATIONS

European Search Report dated Apr. 19, 2011 in corresponding EP Application No. 11001607.8.

(Continued)

*Primary Examiner* — Terrell McKinnon
*Assistant Examiner* — Daniel Breslin
(74) *Attorney, Agent, or Firm* — Faegre Baker Daniels LLP

(57) ABSTRACT

A modular tank stand is lightweight and easily transportable, but also capable of supporting the weight of a large bulk storage container filled with flowable material. The modular tank stand includes a plurality of individual tank stand sections which are interconnectable with one another to form a larger support surface sized to receive the bulk storage container. The individual sections include integral, vertically disposed support walls that provide both vertical support for the weight of the bulk storage container and resistance to collapse under shear forces arising from movement of the container. The interconnecting individual sections may be disconnected from one another and reconfigured to fit in a smaller space, such as onto a pallet or within a shipping container, thereby facilitating storage of the disassembled modular tank stand.

30 Claims, 14 Drawing Sheets

(56) References Cited

U.S. PATENT DOCUMENTS

| | | | | | |
|---|---|---|---|---|---|
| 4,847,028 | A | | 7/1989 | Snyder et al. | |
| 4,887,731 | A | | 12/1989 | Pett et al. | |
| 4,889,254 | A | * | 12/1989 | Vola | 220/23.4 |
| 5,105,746 | A | * | 4/1992 | Reynolds | 108/56.1 |
| 5,117,596 | A | | 6/1992 | Leslie et al. | |
| 5,173,346 | A | * | 12/1992 | Middleton | 428/53 |
| 5,199,570 | A | | 4/1993 | McKenzie | |
| 5,226,558 | A | * | 7/1993 | Whitney et al. | 220/571 |
| 5,490,603 | A | | 2/1996 | Davis | |
| 5,809,905 | A | | 9/1998 | John et al. | |
| 5,848,830 | A | * | 12/1998 | Castle et al. | 362/84 |
| D404,236 | S | * | 1/1999 | Bergwall et al. | D6/582 |
| 5,860,369 | A | * | 1/1999 | John et al. | 108/57.26 |
| 5,904,021 | A | * | 5/1999 | Fisher | 52/578 |
| 6,079,580 | A | | 6/2000 | Garton et al. | |
| 6,116,552 | A | | 9/2000 | Johnson | |
| 6,193,099 | B1 | | 2/2001 | Garton et al. | |
| 6,247,594 | B1 | | 6/2001 | Garton | |
| 6,276,285 | B1 | * | 8/2001 | Ruch | 108/57.13 |
| 6,474,496 | B1 | | 11/2002 | Garton | |
| 6,484,899 | B1 | | 11/2002 | Garton | |
| 6,561,739 | B1 | * | 5/2003 | Garala | 410/46 |
| 6,588,167 | B2 | * | 7/2003 | Chang | 52/590.1 |
| 7,004,082 | B2 | * | 2/2006 | Yang | 108/50.12 |
| 7,059,575 | B2 | | 6/2006 | Garton | |
| 7,107,914 | B2 | | 9/2006 | Sherman | |
| 7,334,529 | B1 | | 2/2008 | Liao | |
| 7,426,890 | B2 | * | 9/2008 | Olvey | 108/51.3 |
| D587,948 | S | * | 3/2009 | Lai | D6/582 |
| 7,555,989 | B2 | | 7/2009 | Sherman | |
| 8,025,468 | B2 | * | 9/2011 | Sever | 410/47 |
| 8,176,857 | B2 | * | 5/2012 | Ochs | 108/64 |
| 2005/0217188 | A1 | * | 10/2005 | Burns | 52/157 |
| 2006/0127647 | A1 | * | 6/2006 | Thrush | 428/172 |

FOREIGN PATENT DOCUMENTS

| | | | | |
|---|---|---|---|---|
| DE | 298 00 696 | | 4/1998 | |
| DE | 299 03 247 | | 9/1999 | |
| EP | 2 103 537 | | 9/2009 | |
| FR | 2 682 021 | | 4/1993 | |
| GB | 2 263 684 | | 8/1996 | |
| GB | 2395188 | A * | 5/2002 | B62B 5/00 |
| GB | 2 395 188 | | 11/2002 | |
| WO | 2008/022380 | | 2/2008 | |

OTHER PUBLICATIONS

European Search Report dated Apr. 19, 2011 in European Patent Application No. 11001607.8.

* cited by examiner

MODULAR TANK STAND

CROSS REFERENCE TO RELATED APPLICATIONS

This application claims the benefit under 35 U.S.C. §119 (e) of U.S. Provisional Patent Application Ser. No. 61/309,243, filed Mar. 1, 2010 and entitled MODULAR TANK STAND, the entire disclosure of which is hereby expressly incorporated herein by reference.

BACKGROUND

1. Technical Field

The present disclosure relates to material storage containers and, specifically, to supports for material storage containers.

2. Description of the Related Art

Bulk storage containers are commonly utilized for storage and dispensing of flowable materials. In some larger bulk storage containers, a valve may be located near the bottom of the container in order to facilitate controlled, gravity-driven dispensing of the flowable material though the valve, so that the container can be drained without a pump, and with no tilting or moving of the container.

One method of ensuring that substantially all of the flowable material contained within a bulk storage container is dispensable via gravitational forces is to position the tank valve at the bottom-most portion of the storage tank wall. However, a bulk storage container with a valve so positioned is generally required to rest on an elevated platform or pedestal, so as to elevate the valve above the ground or other tank support surface. Further, a bulk storage container with a valve positioned at the bottom-most portion of the container must typically be placed upon a pallet or platform, in order to prevent valve damage.

Where a bulk storage container is elevated by a platform or pedestal, the platform or pedestal must be capable of supporting the weight of the bulk storage container and its contents. In the case of bulk liquid storage containers, containment capacities may be up to 10,000 gallons or more, with liquids or other flowable materials having weights of up to 10 lbs./gallon or more. Thus, tank support surfaces and platforms may be called upon to support in excess of 100,000 lbs.

One known method of supporting such bulk storage containers, illustrated in FIG. 1, is to create a poured and/or steel-reinforced concrete pedestal 1 in an area where the container 2 will be located, and position container 2 so that a bottom-mounted full-drain outlet 3 hangs over the edge of concrete pedestal 1. A disadvantage with concrete tank stands is that the concrete must be poured at a selected location and is thereafter not movable. This provides limited flexibility for storage areas including a large number of tanks, in that the tank stands must typically be planned as part of the building architecture and are permanently fixed.

Alternatively, a single-piece steel frame can be used in place of concrete pedestal 1 to elevate and support container 2. Steel frame tank stands may be moved to allow reconfiguration of a number of storage tanks, but are often formed as single components that are heavy and difficult to ship from their manufacturing site to a use location. Further, steel reacts adversely with certain chemicals stored in the tanks supported by the steel frame tank stand, potentially shortening the service life or reliability of a steel stand.

Known tank stands, as noted above, are generally permanent structures and/or require forklifts, cranes, or other heavy lifting equipment to move. Known modular weight-bearing designs, on the other hand, are not designed for the heavy loads typically encountered in a tank stand application.

What is needed is a tank stand that is lightweight and transportable, yet strong enough to handle large loads without becoming structurally compromised. Ideally, such a tank stand will also be resistant to chemicals.

SUMMARY

The present disclosure provides a modular tank stand that is lightweight and easily transportable, but also capable of supporting the weight of a large bulk storage container filled with a flowable material. The modular tank stand includes a plurality of individual tank stand sections which are interconnectable with one another to form a larger support surface sized to receive the bulk storage container. The individual sections include integral, vertically disposed support walls that provide both vertical support for the weight of the bulk storage container and resistance to collapse under shear forces arising from movement of the container. The interconnecting individual sections may be disconnected from one another and reconfigured to fit in a smaller space, such as onto a pallet or within a shipping container, thereby facilitating storage and transport of the disassembled modular tank stand.

In one form thereof, the present disclosure provides a modular tank stand assembled from a plurality of connectable tank stand sections, the modular tank stand comprising: a first tank stand section comprising: a first ground contacting surface; a first container support surface spaced vertically from the first ground contacting surface; a first wall extending between the first ground contacting surface and the first container support surface; and at least one lobe associated with the first peripheral wall, the lobe defining a lateral lobe width, the lobe width increasing as the lobe extends outwardly away from the first peripheral wall. The modular tank stand further includes a second tank stand section comprising: a second ground contacting surface; a second container support surface spaced vertically from the second ground contacting surface; and a second wall extending between the second ground contacting surface and the second container support surface; and at least one cavity associated with the second peripheral wall, the cavity defining a lateral cavity width, the cavity width increasing as the cavity extends inwardly away from the second peripheral wall, wherein the lobe interconnects with the cavity to restrain lateral movement of the first tank stand section with respect to the second tank stand section, while allowing vertical movement of the first tank stand section with respect to the second tank stand section.

In one aspect, the lobe is one of unitarily formed with the first tank stand section and separately formed from the first tank stand section.

In another form thereof, the present disclosure provides a modular tank stand comprising: a plurality of modular tank stand sections each comprising: a container support surface defining a lateral support surface expanse; and a peripheral wall defining a vertical tank stand section height; and means for connecting the plurality of modular tank stand sections to one another, the means for connecting restricting lateral movement of the plurality of modular tank stand sections with respect to one another while permitting vertical movement.

In yet another form thereof, the present disclosure provides a method of constructing a modular tank stand for supporting a bulk storage container, the method comprising: providing a plurality of tank stand sections, each tank stand section including a container support surface at least partially bounded by a peripheral wall extending away from the container support surface, each of the plurality of tank stand sections including at least one of: a lobe extending from the peripheral wall, the lobe defining a lateral lobe width that increases as the lobe extends outwardly away from the peripheral wall, and a cavity extending into the peripheral wall, the cavity defining a lateral cavity width that increases as the cavity extends inwardly away from the peripheral wall; placing a first tank stand section on an underlying support surface suitable to support the weight of the modular tank stand and a filled bulk storage container; and interconnecting the cavity with the lobe by vertically lowering a second tank stand section into engagement with the first tank stand section, the step of interconnecting preventing lateral movement between the first and second tank stand sections.

In still another form thereof, the present disclosure provides a tank stand comprising: a plurality of interconnecting tank stand sections, each tank stand section monolithically formed of a polymer material; the tank stand sections capable of being assembled and interconnected to form a substantially circular, aggregated container support surface having a surface diameter of at least 120 inches; the plurality of tank stand sections having a total weight of up to 1260 lbs; and the plurality of tank stand sections capable of supporting a force of at least 150,000 lbs with material deflection remaining under 0.063 inches when the tank stand sections are assembled and interconnected.

In one aspect, the plurality of tank stand sections are capable of supporting a force of at least 300,000 lbs with material deflection remaining under 0.063 inches when the tank stand sections are assembled and interconnected.

BRIEF DESCRIPTION OF THE DRAWINGS

The above mentioned and other features and advantages of the present disclosure, and the manner of attaining them, will become more apparent and the invention itself will be better understood by reference to the following description of an embodiment of the invention taken in conjunction with the accompanying drawings, wherein.

Corresponding reference characters indicate corresponding parts throughout the several views. The exemplifications set out herein illustrate an exemplary embodiment of the invention and such exemplifications are not to be construed as limiting the scope of the invention in any manner.

DETAILED DESCRIPTION

As indicated above, the present disclosure provides a modular tank stand comprised of a plurality of individual tank stand sections which may be disassembled for transport and storage. When assembled, the tank stand sections are interconnected with one another, thereby creating a lightweight and relocatable modular tank stand capable of supporting the weight of a fully filled bulk storage container.

1. Modular Tank Stand Sections

Figure 1:
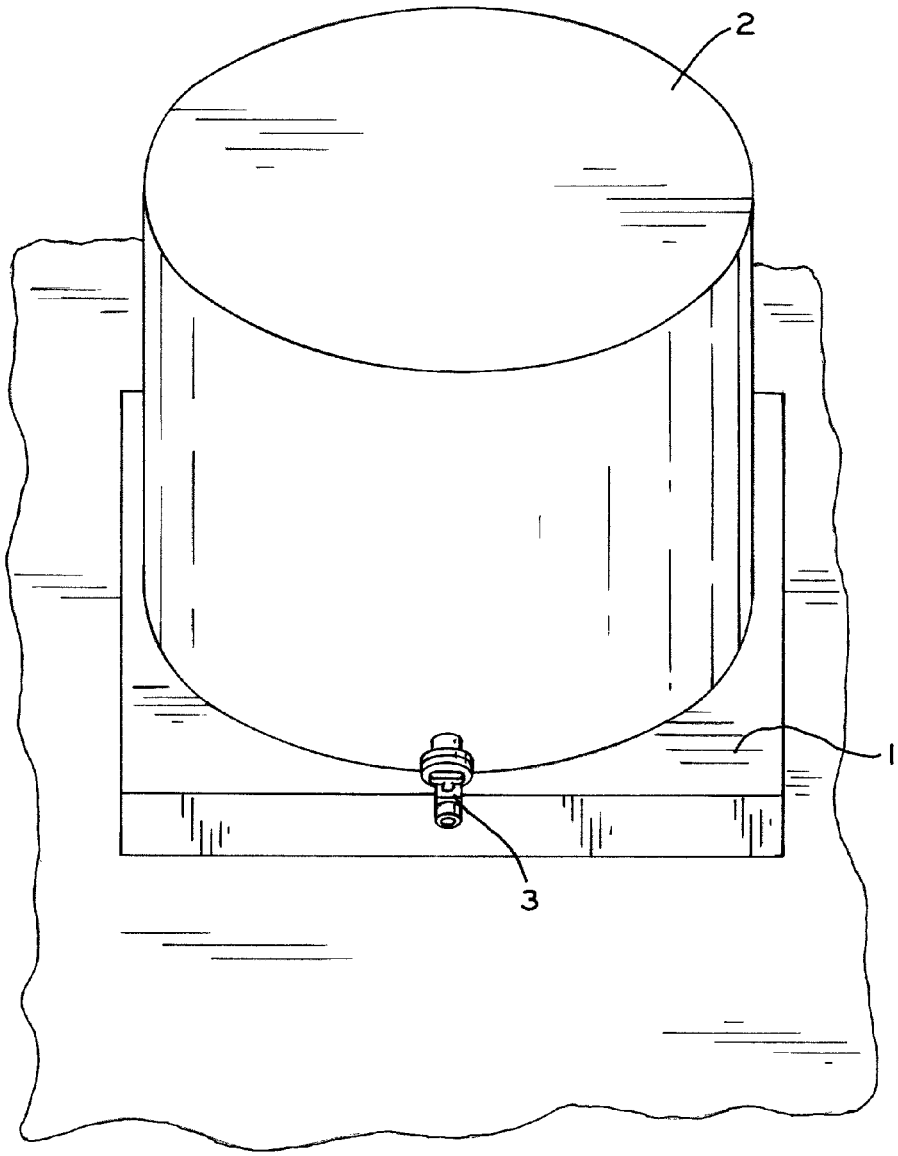
FIG 1 PRIOR ART
FIG. 1 is a perspective view of a known tank stand with a bulk storage container resting thereon.
Figure 2:
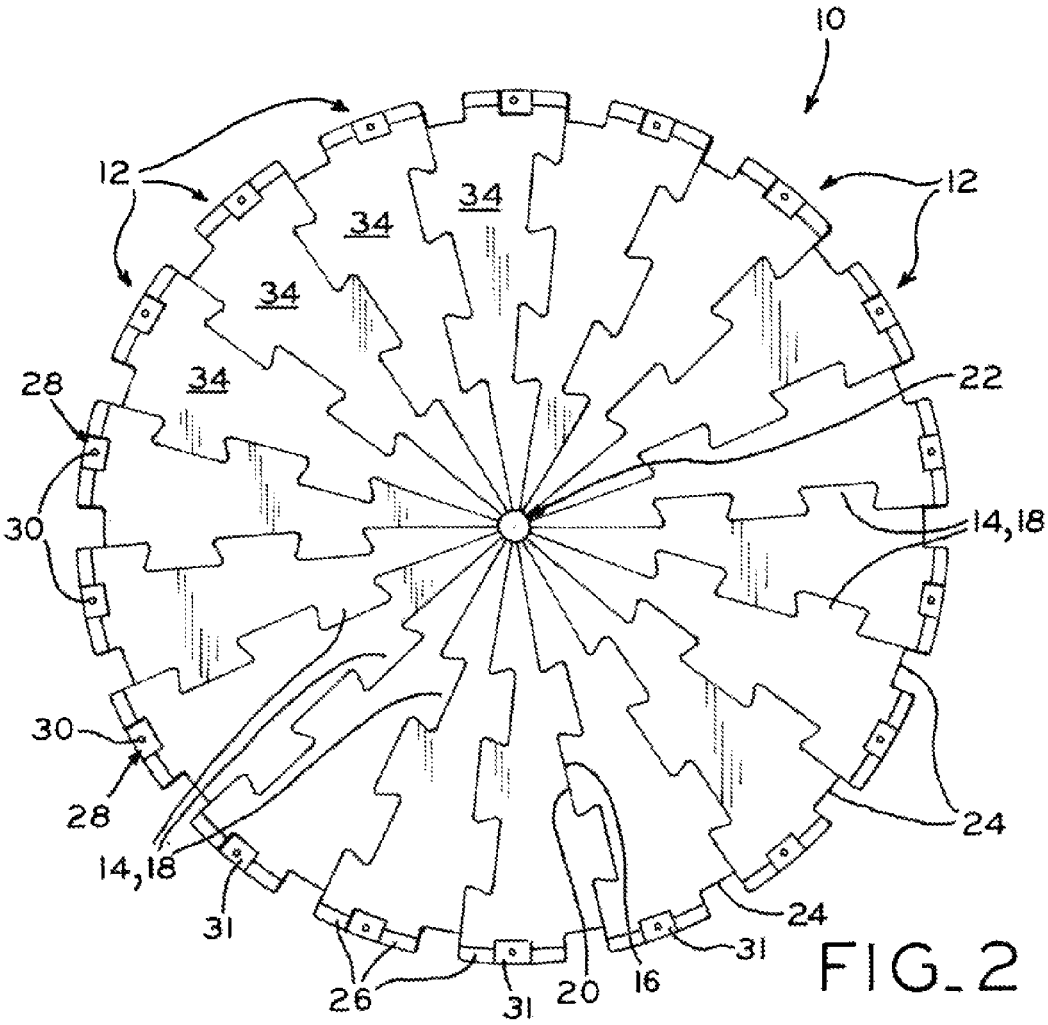
FIG. 2 is a top plan view of a modular tank stand comprised of a plurality of tank stand sections.
Figure 4:
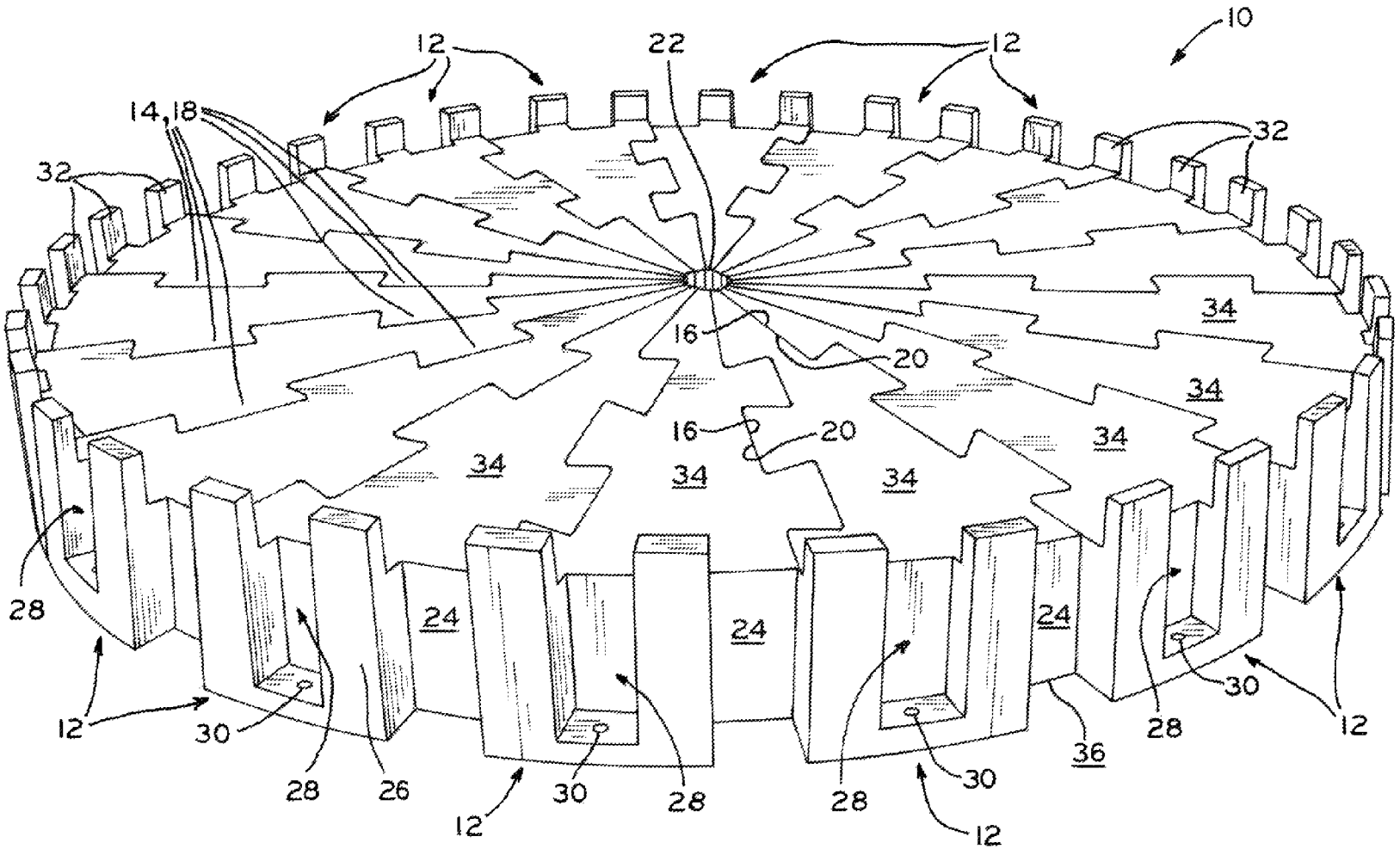
FIG. 4 is a perspective view of the modular tank stand shown in FIG. 2.

Referring now to FIGS. 2 and 4, modular tank stand 10 includes a plurality of tank stand sections 12 which interconnect or interleave with one another to create a generally circular support surface sized and shaped to support a cylindrical bulk storage container or tank 50, as shown in FIGS. 6, 7, 9 and 10 and described in detail below. In one exemplary embodiment, bulk storage container 50 may be made of a rigid or semi-rigid rotationally molded plastic material, such as polyethylene, nylon, polyvinyl chloride (PVC), or the like. Container 50 is adapted to contain liquids such as industrial chemicals, petroleum products, water, food products, and the like. However, container 50 may contain and dispense any flowable material, such as granular materials, seeds and grain.

Tank stand section 12 has a wedge or triangular shape, with acute angle Θ formed between radial lobe wall 16 and radial cavity wall 20. Radial lobe wall 16 and radial cavity wall 20 converge toward a "tip" or "point" of the wedge-shaped section 12, which is blunted to form center wall section 23. When modular tank stand 10 is assembled, center wall sections 23 each define a portion of center wall 22, as illustrated in FIGS. 2 and 4. Radial lobe wall 16 and radial cavity wall 20 diverge toward a generally arcuate perimeter wall 24, which is disposed opposite center wall 22. Perimeter wall 24 forms the "triangle base" for wedge-shaped tank stand section 12.

Figure 3A:
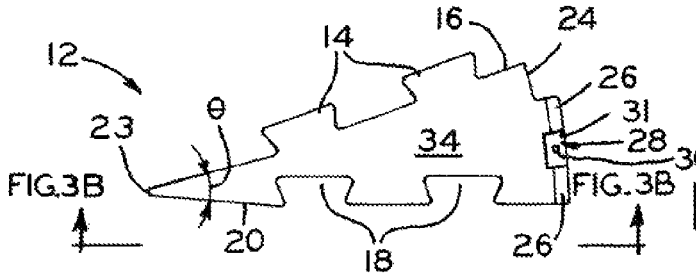
FIG. 3A is a top plan view of a single tank stand section shown in FIG. 2.
Figure 3B:
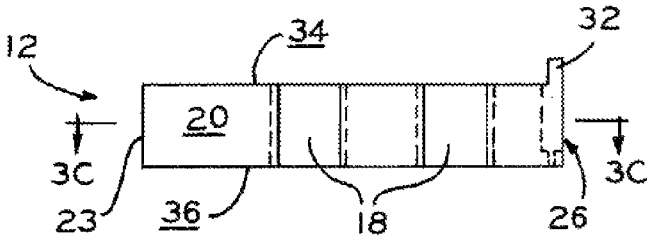
FIG. 3B is a side elevation view of the tank stand section shown in FIG. 3A.
Figure 3C:
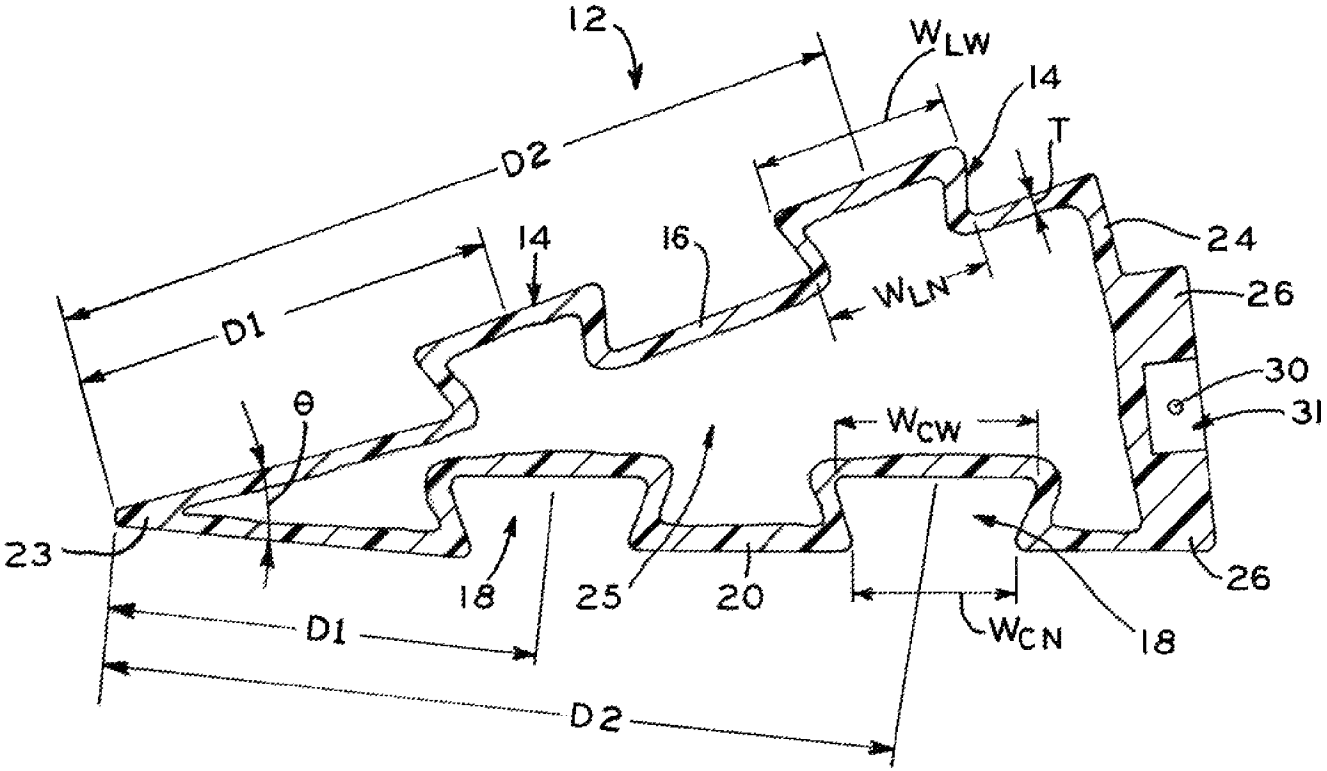
FIG. 3C is a top plan, cross-sectional view of the tank stand section shown in FIGS. 3A and 3B.

As best seen in the detail view of FIG. 3A, tank stand sections 12 include interconnecting lobes 14 protruding from radial lobe wall 16, and interconnecting cavities 18 protruding into radial cavity wall 20. Together, lobes 14 and cavities 18 form a dovetail-type connection between respective tank stand sections 12. As shown in FIG. 3C, lobe 14 defines a relatively narrow lobe width $W_{LN}$ at the point where lobe 14 meets radial lobe wall 16, but the lobe width steadily expands as lobe 14 extends outwardly away from lobe wall 16 to relatively wider lobe width $W_{LW}$. Similarly, cavity 18 defines a relatively narrow cavity width $W_{CN}$ at the point where cavity 18 meets cavity wall 20, and the cavity width steadily expands as cavity 18 extends inwardly away from cavity wall 20 to relatively wider cavity width $W_{CW}$. In order to facilitate assembly of modular tank stand 10 (as discussed below), widths $W_{LN}$, $W_{LW}$ of lobe 14 is slightly less than width $W_{CN}$, $W_{CW}$ of cavity 18, thereby providing for a clearance fit therebetween.

Referring still to FIG. 3C, the distances D1, D2 between each interconnecting lobe 14 and center wall section 23 are substantially equal to the corresponding distances D1, D2 between respective interconnecting cavities 18 and center wall section 23, allowing any tank stand section 12 to interconnect with any other tank stand section 12. Moreover, the common shape, size and orientation between interconnecting lobes and cavities 14, 18 allows a plurality of substantially identical tank stand sections 12 to be interconnected with one another in any order to assemble modular tank stand 10.

Although the illustrated embodiment has two cavities 18 on one side of each tank stand section 12 and two corresponding lobes 14 on the other side of each tank stand section 12, it is within the scope of the present disclosure that the number, location and configuration of lobes 14 and cavities 18 may be varied as required or desired for a particular application. For example, fewer or more cavities and lobes may be formed on each side of tank stand section 12, or each side may include both a cavity and a lobe.

Referring now to FIGS. 2-4, perimeter wall 24 includes a pair of perimeter wall columns 26. Gap 28 is formed between columns 26, with securement aperture 30 extending through a web 31 which connects end portions of perimeter wall columns 26. Lip 32 extends upwardly from a portion of columns 26. Columns 26 provide a solid structural support at perimeter wall 24, and lip 32 provides lateral support to prevent or restrain shifting or sliding of a bulk storage container disposed upon modular tank stand 10, as discussed in detail below. Securement apertures 30 facilitate anchoring of tank stand section 12 to a tank stand support surface, such as a reinforced concrete floor or pad. For example, fasteners 33 (FIG. 5) may be driven through apertures 30 and into fixed engagement with the tank stand support surface. With at least two fasteners 33 driven fully into respective apertures 30 of any two of sections 12 so that the heads of fasteners 33 contact respective webs 31, modular tank stand 10 is fixedly secured to the tank stand support surface.

As best seen in FIGS. 3A and 3C, the periphery of tank stand section 12 includes walls 16, 20, 23, 24, which in turn bound an upper container support surface 34. Lower ground contacting surface 36 (FIG. 3B) is disposed opposite, and spaced vertically from, container support surface 34. In an exemplary embodiment, ground contacting surface 36 is parallel to container support surface 34 and surfaces 34, 36 have substantially identical outer profiles. Container support surface 34 forms a continuous planar surface connecting each of walls 16, 20, 23, 24. Container support surface 34 and ground contacting surface 36 are generally horizontal in use (as described below), and can therefore be said to occupy a lateral expanse. Concomitantly, walls 16, 20, 23, 24 can be said to vertically extend between surfaces 34, 36, as walls 16, 20, 23, 24 are normal to surfaces 34, 36 along the entire respective vertical extents.

It is also contemplated that container support surfaces may have non-planar and/or non-level lateral surfaces, such that the aggregated container support surface of modular tank stand 10 is other than flat and level. For example, the aggregated container support surface may be conical, planar and sloped, spherical or any other desired shape, such as for accommodation of correspondingly shaped bottoms of bulk storage container 50.

Referring to FIG. 3C, walls 16, 20, 23, 24 and container support surface 34 may have equal or unequal thicknesses T, and, in one embodiment, may be as thin as 0.188 inches or as thick as 1.50 inches, or any thickness between the foregoing values. In one exemplary embodiment, described in further detail in the "Example" section below, tank stand sections 12 are made of a rotationally-molded polymer material, such as polyethylene, and each of walls 16, 20, 23, 24 have a uniform thickness T of approximately 0.75 inches. Upper container support surface 34 may also be approximately 0.75 inches thick. Walls 16, 20, 23, 24 encircle interior 25 of tank stand section 12.

For a given material or material composition of tank stand sections, it is contemplated that wall thicknesses T for other embodiments of modular tank stands may be less than or greater than the values described above. For example, wall thickness may vary depending upon the size and weight of the container to be supported, the material(s) from which the modular tank stand is formed, the service environment of the modular tank stand, and the like.

In an exemplary embodiment, lower ground contact surface 36 is a substantially continuous planar surface interconnecting each of walls 16, 20, 23, 24, similar to container support surface 34. Advantageously, this closed lower surface cooperates with container support surface and walls 16, 20, 23, 24 to bound and enclose interior 25. Interior 25 may be formed as a sealed enclosure during the manufacturing process (as described below), thereby preventing ingress of potentially bacteria-forming fluids into interior 25. Alternatively, ground contacting surface 36 may have drain holes (not shown) formed therein, or may be a completely open profile, i.e., may be comprised only of the edges of walls 16, 20, 23, 24.

Figure 7:
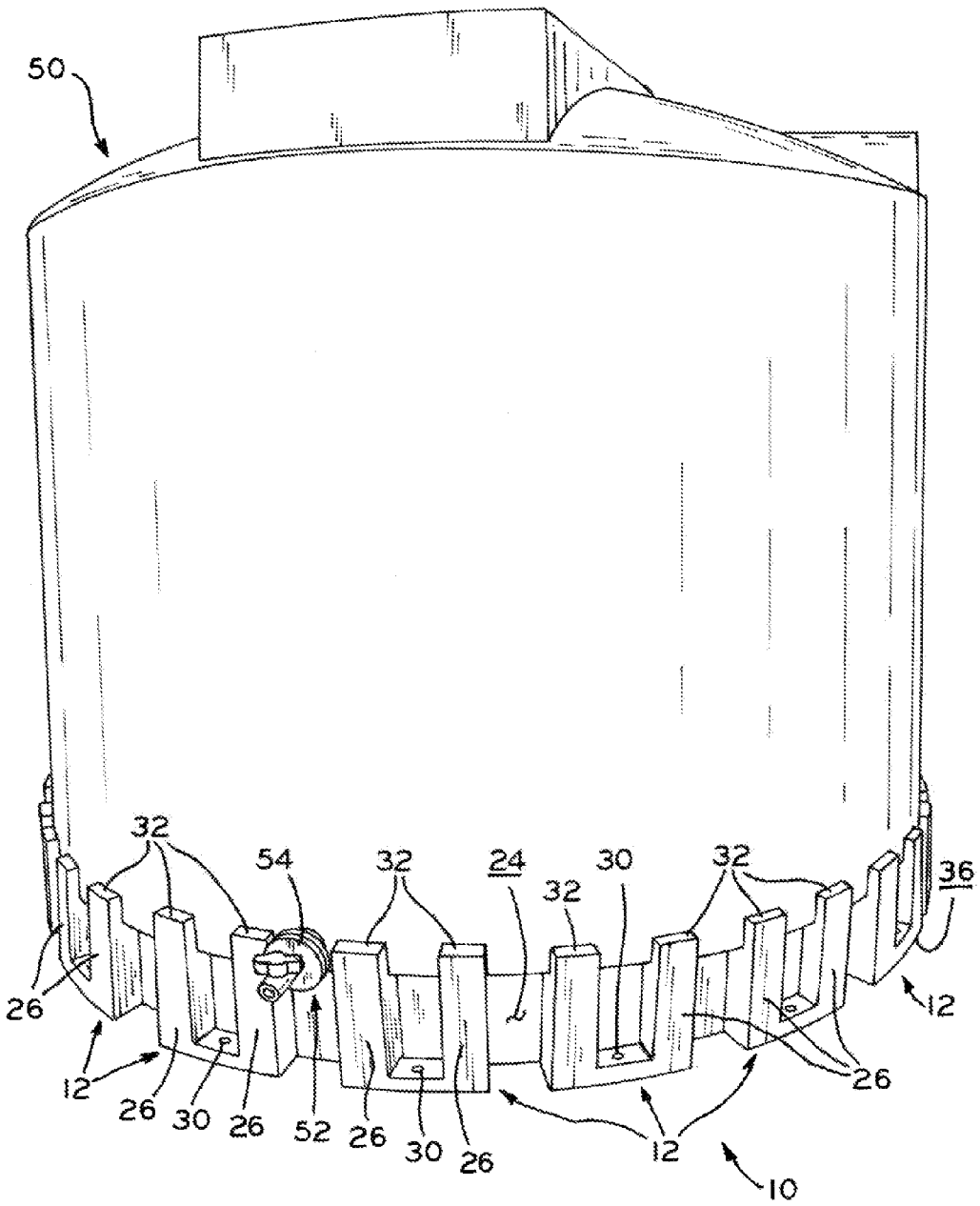
FIG. 7 is a perspective view of an assembled modular tank stand with a bulk storage container disposed thereon.

In either of the foregoing embodiments, walls 16, 20, 23, 24 and surfaces 34 and/or 36 at least partially bound interior 25, which is hollow or substantially hollow. For purposes of the present disclosure, interior 25 being "substantially hollow" contemplates all or part of interior 25 including a material having a lower density than the material of walls 16, 20, 23, 24 and/or surfaces 34, 36. Such lower density material may include sponge material, honeycomb or other matrix-based structures, expanded foams, insulations, and the like. The hollowness or substantial hollowness of interior 25 reduces the weight of tank support sections 12, while the design of walls 16, 20, 23, 24 and surfaces 34, 36 provides ample support for the weight of bulk storage container 50 on support surfaces 34, as shown in FIG. 7 and described in detail below.

2. Assembly of the Modular Tank Stand

Figure 5:
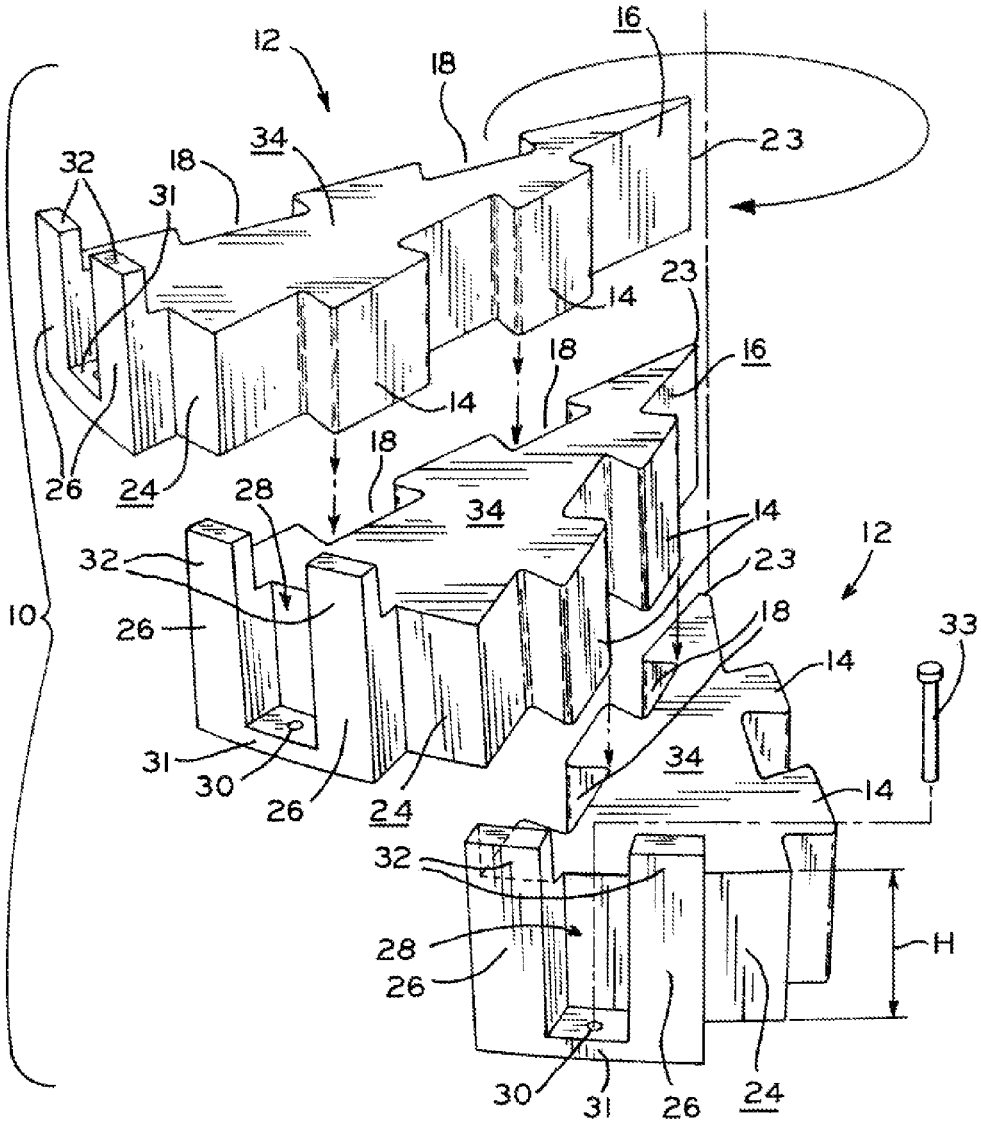
FIG. 5 is a schematic, perspective view showing initial steps in the assembly of the modular tank stand shown in FIGS. 2 and 4.

Referring now to FIG. 5, modular tank stand 10 is assembled by interconnecting a plurality of tank stand sections 12. First, a first tank stand section 12 is positioned to receive a bulk storage container on a flat and level tank stand support surface of suitable size and strength for supporting tank stand 10, container 50 (FIG. 7) and any flowable material to be stored in container 50. Exemplary support surfaces include concrete container pads and reinforced concrete warehouse floors adapted to support the weight of a fully loaded container. Lower ground contacting surface 36 of a first tank stand section 12 is positioned to rest upon the tank stand support surface, such that lip 32 extends upwardly away from the support surface.

Next, a second tank stand section 12 is lowered into engagement with the first tank stand section 12 by vertically sliding interconnecting lobes 14 of the second tank stand section 12 into interconnecting cavity 18 of the first tank stand section 12. With two tank stand sections 12 thus interconnected, the radial lobe wall 16 of one of the tank stand sections 12 is disposed adjacent or abutting the radial cavity wall 20 of the other tank stand section 12. When the second tank stand section 12 is fully engaged with the first tank stand section 12, their respective support surfaces 34 are substantially coplanar.

Additional tank stand sections 12 are similarly vertically lowered into interconnected engagement with adjacent tank stand sections 12. When assembly of tank stand 10 is complete, a generally circular, substantially continuous, aggregated support surface comprised of the various support surfaces 34 of tank stand sections 12 is formed. In exemplary embodiments, twelve (12) to eighteen (18) tank stand sections are used to create a complete modular tank stand. In the illustrated embodiment of FIGS. 2 and 4, eighteen (18) of tank stand sections 12 are used to create modular tank stand 10. Thus, angle Θ (FIG. 3C) of each tank stand section 12 is approximately 20 degrees, so that eighteen (18) of tank stand sections 12 create the 360 degree circular profile shown in FIG. 2. Similarly, angle Θ can be calculated for any given number of tank stand sections 12 by dividing 360 degrees by the number of sections 12 to be used.

However, it is contemplated that the number of tank stand sections used to complete modular tank stand 10 may be reduced or increased, i.e., angle Θ of tank stand sections 12 may be made larger or smaller, so that as few as two or as many as several dozen tank stand sections may be used as constituent pieces of the complete modular tank stand. It is also within the scope of the present disclosure that the modular tank stand may also be a single circular piece, i.e., tank stand sections 12 may be fused to one another or integrally formed as a single unit.

In the exemplary embodiment shown in FIGS. 3A and 3C, lobes 14 are monolithically, integrally, and unitarily formed as a part of tank stand section 12. In order to facilitate the connection of respective tank stand sections 12 to one another, some clearance is provided between interconnecting lobes 14 and interconnecting cavities 18 (i.e., lobe width is slightly less than cavity width, as noted above). This clearance allows the respective sections 12 to be easily slid into place. In addition, the aggregated tolerances between the various tank stand sections 12 allow the assembler to slightly shift adjacent sections 12, as necessary, when the final tank stand section 12 is added to modular tank stand assembly 10.

Figure 11:
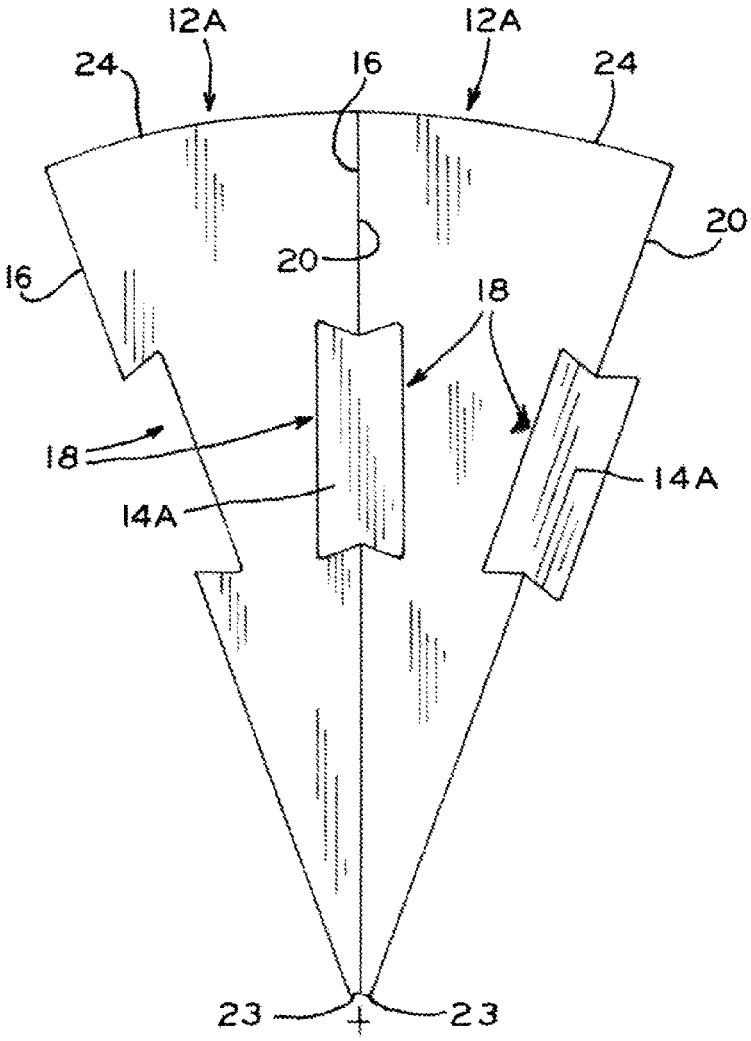
FIG. 11 is a top plan view of another embodiment of interconnected modular tank stand sections in accordance with the present disclosure.

However, it is contemplated that lobes 14 may also be formed as structures separate and distinct from tank stand section 12. Referring to FIG. 11, for example, tank stand sections 12A still include walls 16, 20, 23, 24, but walls 16, 20 both include cavities 18 and both exclude lobes 14. The function provided by lobe 14 in tank stand section 12 is instead accomplished by a "figure-8" type key 14A can be vertically lowered into a pair of adjacent cavities 18 when tank stand sections 12A are aligned as shown. In the embodiment of FIG. 11, a "lobe" corresponding to lobe 14 is provided by the portion of key 14A that extends away from walls 16 and/or 20. Thus, it can be said that key 14A provides a non-integral, removable lobe for interconnection with cavity 18.

Figure 12A:
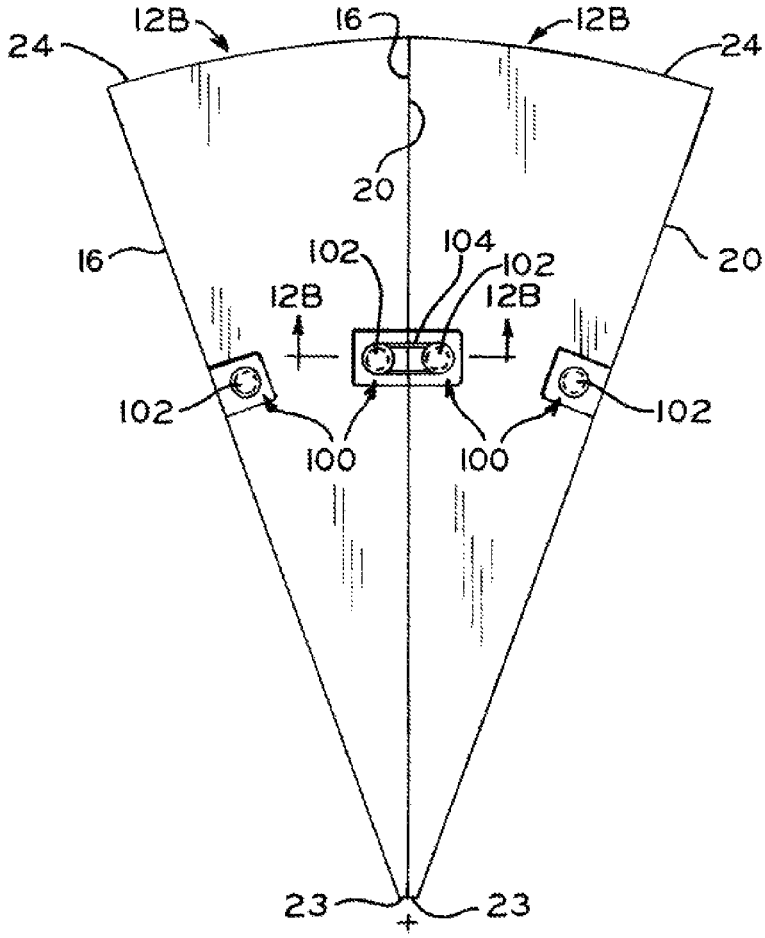
FIG. 12A is a top plan view of yet another embodiment of interconnected modular tank stand sections in accordance with the present disclosure.
Figure 12B:
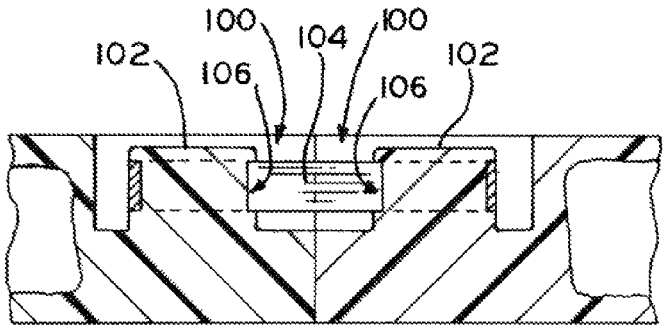
FIG. 12B is an partial elevation, section view of the modular tank stand sections shown in FIG. 12A, illustrating a lateral connection assembly.

Moreover, constituent sections of a modular tank stand in accordance with the present disclosure may be connected to one another by any suitable fastening method, in addition to or in lieu of interconnecting lobes 14 and cavities 18 as described herein. Referring to FIG. 12A, for example, tank stand sections 12B include recesses 100 formed adjacent walls 16 and 20, with stanchions 102 occupying part of recesses 100. Stanchions 102 are joined to one another by connecting band 104, which thereby joins tank stand sections 12B to one another. As shown in FIG. 12B stanchions 102 may have an annular recess 106 to aid in retention of band 104. Connecting bank 104 may be an adjustable hose clamp-type device, or elastomeric device, or nylon webbing, or the like.

Figure 13A:
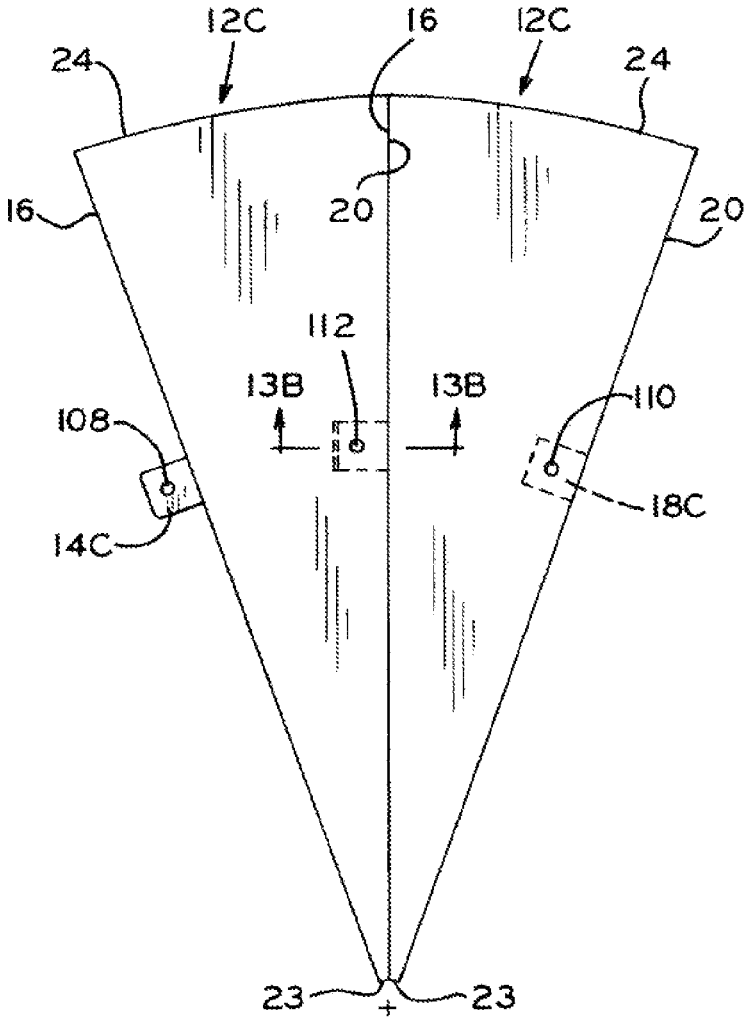
FIG. 13A is a top plan view of still another embodiment of interconnected modular tank stand sections in accordance with the present disclosure.
Figure 13B:
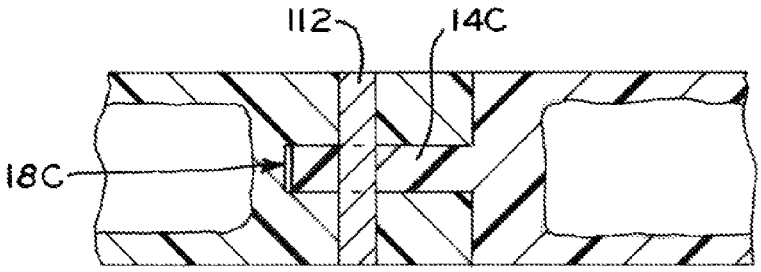
FIG. 13B is an partial elevation, section view of the modular tank stand sections shown in FIG. 13A, illustrating a lateral connection assembly.

In another embodiment, shown in FIG. 13A, tank stand sections 12C may include lobe 14C which maintains a constant width as it extends away from wall 16. Correspondingly, cavity 18C also maintains a constant width as it extends into wall 20. Lobe 14C includes aperture 108, extending vertically therethrough, while cavity 18C has aperture 110 extending vertically through the upper and lower walls bounding cavity 18C. Lobe 14C is matingly received in cavity 18C, and pin 112 (see FIG. 13B) is driven through apertures 108, 110 to interconnect a pair of tank stand sections 12C.

Still other connection methods and devices may be used to join respective tank stand sections to one another to form a complete modular tank stand. Some such devices include traditional (i.e., threaded) fasteners, adhesives, hook-and-loop type fasteners, rivets, and the like. Connection methods may include welding, fusing or melting tank stand sections to one another. In exemplary embodiments (such as tank stand sections 12A shown in FIG. 11), these alternative methods of connection preserve the lateral securement of tank stand sections 12 with respect to one another (i.e., preventing or restricting any lateral movement of sections 12 with respect to adjacent sections 12), while still allowing for vertical-movement methods of assembly and disassembly as described herein. In yet another alternative embodiment, tank stand sections may not be fastened to one another, but simply arranged adjacent one another to form a container support surface.

Figure 6:
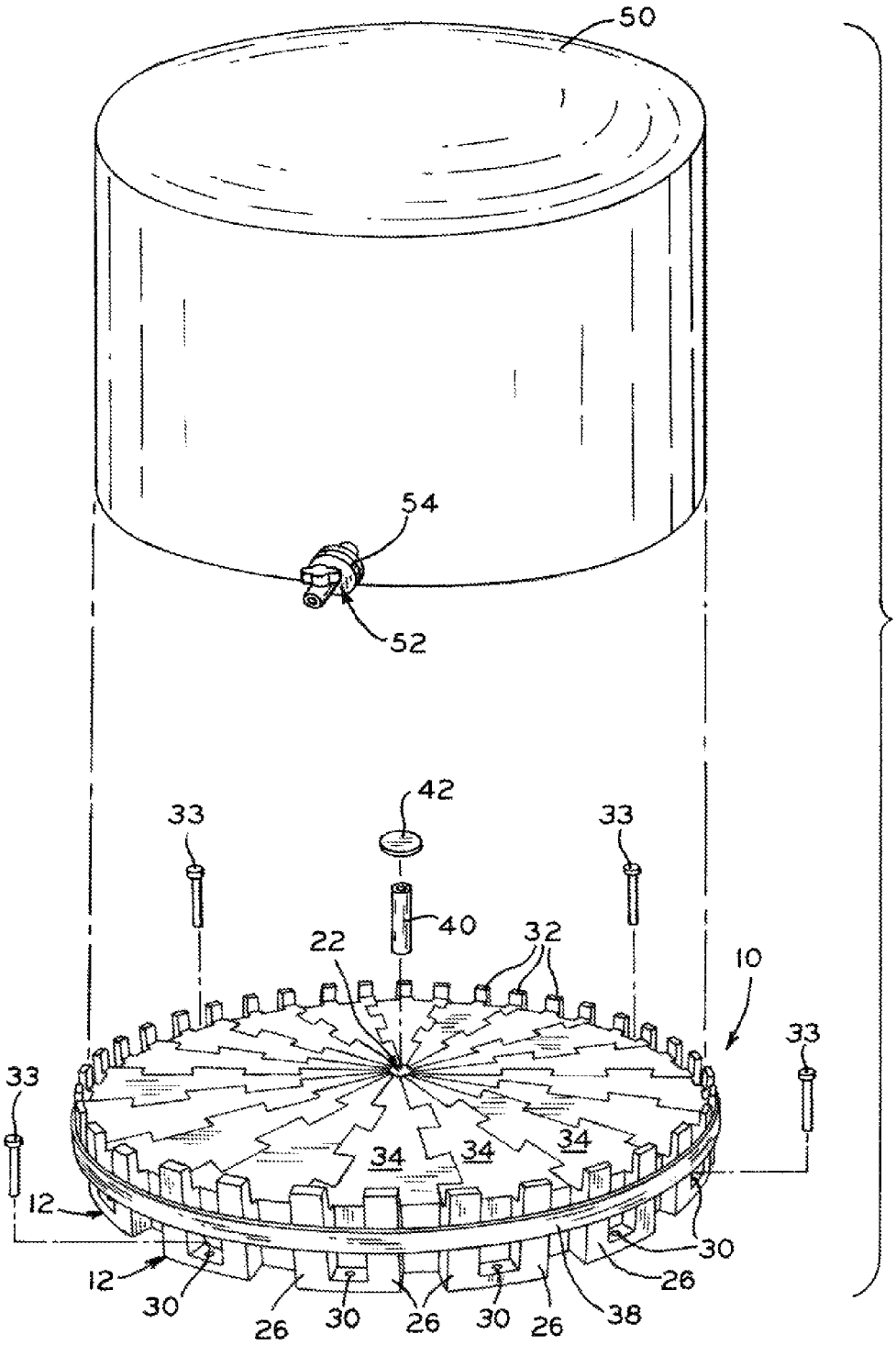
FIG. 6 is a schematic, perspective view showing additional assembly steps for mounting a storage container on the modular tank stand shown in FIGS. 2 and 4.

Returning to modular tank stand 10 shown in FIGS. 2-5, the aggregated tolerances between interconnecting lobes 14 and cavities 18 of tank stand sections 12 (discussed above) can render the container support surface of modular stand 10 slightly oval or oblong. Referring to FIG. 6, strap 38 may optionally be provided to ensure that modular tank stand 10 defines a circular support surface prior to installation of bulk storage container 50. Strap 38 is loosely wrapped around the perimeter of modular tank stand 10, such that strap 38 comes into contact with perimeter columns 26 of respective tank stand sections 12.

A generally cylindrical pipe or shaft 40 (FIG. 6) having an axial length equal to height H of tank stand sections 12 is optionally assembled into the central aperture of modular tank stand 10, such that shaft 40 sits adjacent center wall 22. Strap 38 is then tightened around the perimeter of modular tank stand 10, which induces a radial inward force that draws tank stand sections 12 toward shaft 40 and creates a true circular profile of the aggregated container support surface (which, as noted above, consists of all container support surfaces 34 in modular tank stand 10). Referring to FIG. 6, center support plate 42 may then be placed over shaft 40. Center support plate 42 extends past center wall 22, providing surface continuity between the respective container support surfaces 34 around the perimeter of center wall 22.

Referring now to FIGS. 6 and 7, when modular tank stand 10 is fully assembled and positioned in a desired location, bulk storage container or container 50 may be placed thereon. In an exemplary embodiment, container 50 may include spout 52 disposed at a bottom portion thereof to facilitate complete drainage of the contents of container 50 through spout 52. Spout 52 includes spout flange 54 which extends below the bottom surface of container 50. Advantageously, modular tank stand 10 elevates container 50 so that spout flange 54 is spaced from the underlying support surface. Thus, modular tank stand 10 facilitates complete drainage of bulk storage container 50 via spout 52 using only gravity by facilitating the placement of spout 52 at the bottom of container 50.

In some service environments, modular tank stand 10 may be called upon to support and contain bulk storage container 50 during seismic activity. For secure bulk storage in seismically active environments, modular tank stand 10 provides a seismic restraint system including of a plurality of fasteners 33 (FIGS. 6 and 8), which prevent movement of modular tank stand 10 with respect to the underlying support surface. The seismic restraint system further includes upwardly extending lips 32, which prevent movement of bulk storage container 50 with respect to modular tank stand 10.

Figure 9:
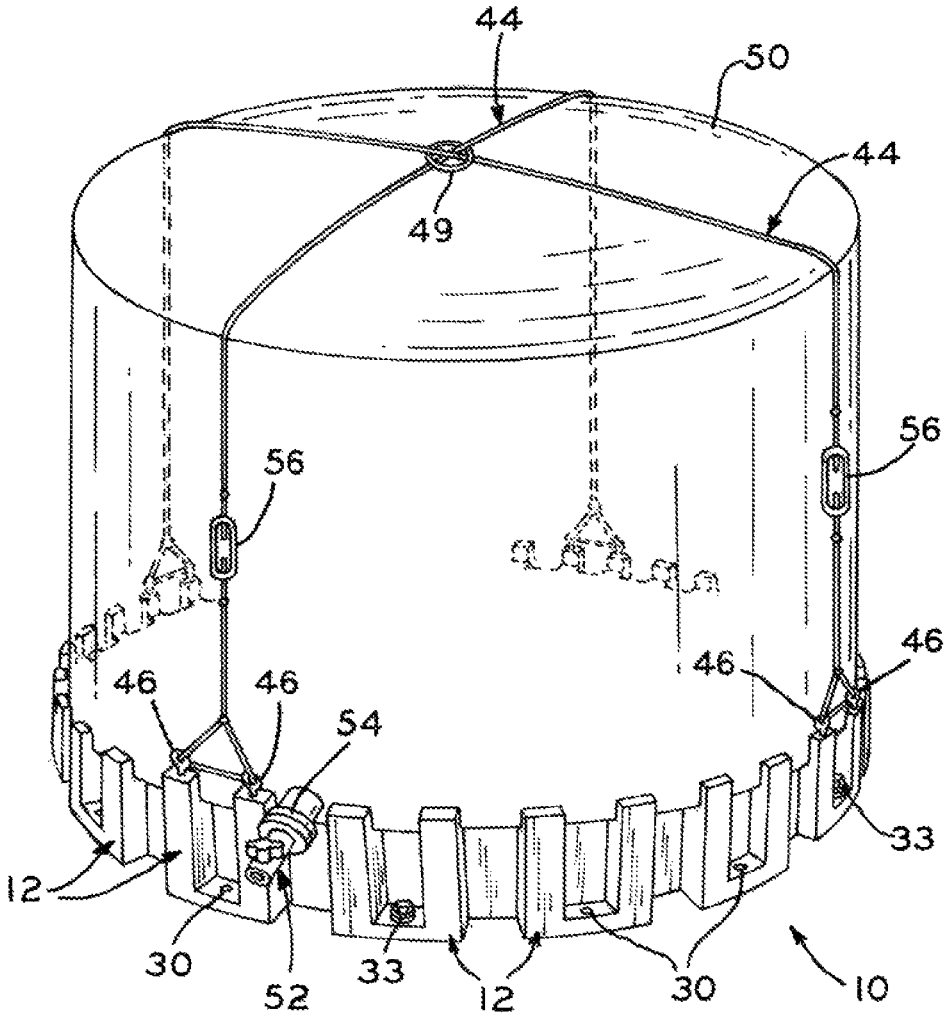
FIG. 9 is a perspective view of a modular tank stand and bulk storage container, illustrating a wind load restraint system.
Figure 10A:
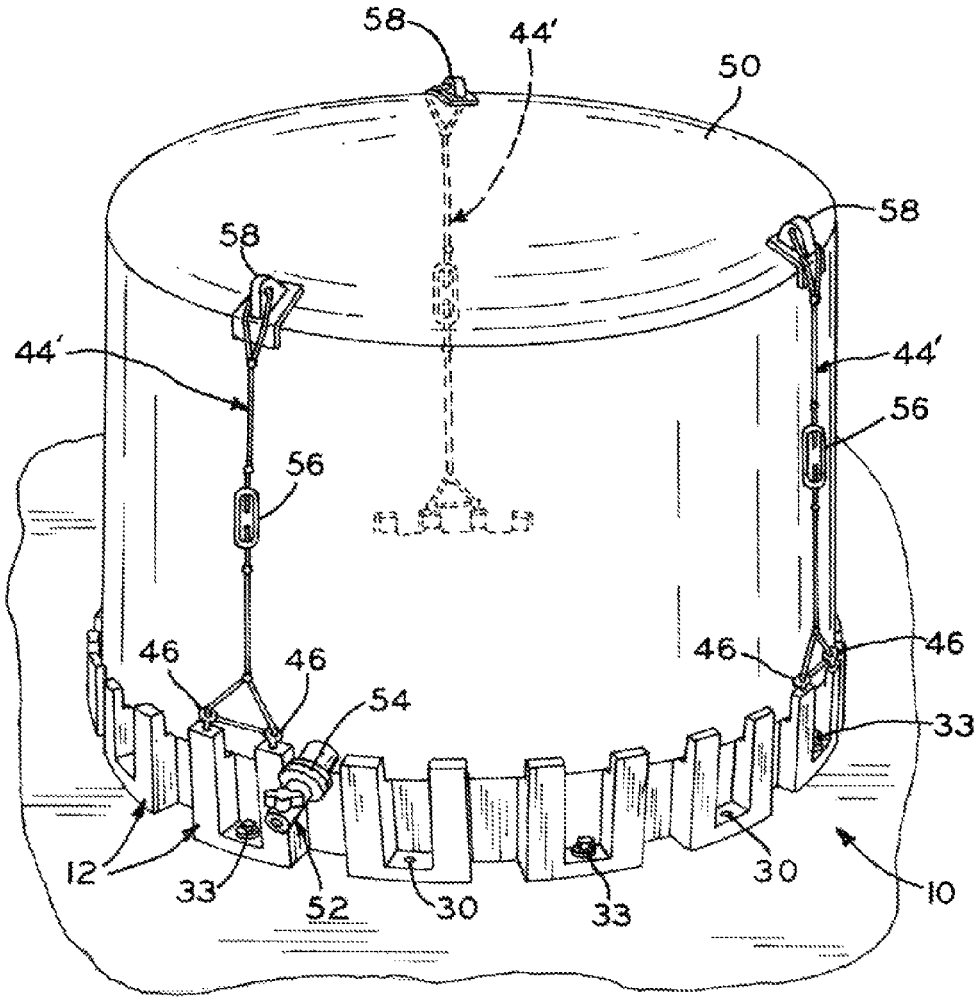
FIG. 10A is another perspective view of a modular tank stand and bulk storage container, illustrating a wind load restraint system.
Figure 10B:
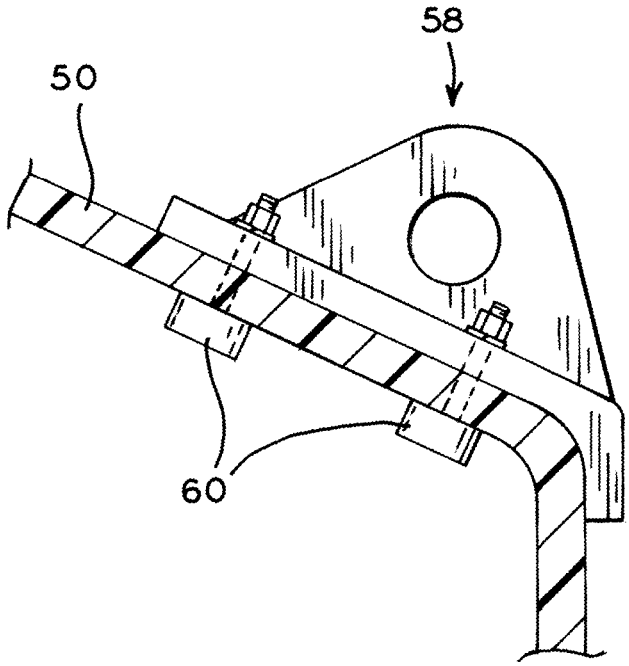
FIG. 10B is a partial elevation, section view of the bulk storage container shown in FIG. 10A, illustrating a cable anchor.

To implement the seismic restraint system, a plurality of fasteners 33 are driven through respective, opposed securement apertures 30 to secure webs 31 of tank stand sections 12 to substrate G of the underlying tank stand support surface, as discussed above. As illustrated in FIGS. 9 and 10, fasteners 33 may be used to attach some or all of tank stand sections 12 to the container support surface, with FIG. 9 illustrating the use of a fastener 33 for every third securement aperture 30, and FIG. 10A illustrating a fastener 33 in every other securement aperture 30. However, any number of fasteners 33 may be employed in establishing seismic restraint for modular tank stand 10, as required or desired for a particular application. When so secured, modular tank stand 10 is effectively prevented from any movements commonly associated with seismic activity, such as sliding or "skittering" across the support surface. Lips 32, in turn, prevent any sliding or skittering of bulk storage container 50 with respect to modular tank stand 10.

In addition to seismically active service environments, modular tank stand 10 may also be used in environments with potentially heavy winds. For secure bulk storage in windy environments, modular tank stand 10 can be provided with a wind-load restraint system. The wind-load restraint system includes fasteners 33, as discussed above with respect to the seismic restraint system, which prevent lateral movement of bulk storage container 50. The wind-load restraint system further includes tie-down cables 44, 44' (FIGS. 9 and 10), which prevent vertical movement or "tipping" of bulk storage container 50.

Turning to FIG. 9, a first tie-down cable 44 passes through a pair of eye bolts 46 in one of tank stand sections 12, passes over the top of bulk storage container 50, and passes through another pair of eye bolts 46 in an opposing tank stand section 12. A second tie-down cable 44 is similarly routed, but positioned to intersect the first tie down cable 44 at the top of bulk storage container 50. In order to join the pair of tie-down cables 44, ring 49 is secured to cables 44 at the junction thereof.

Figure 8:
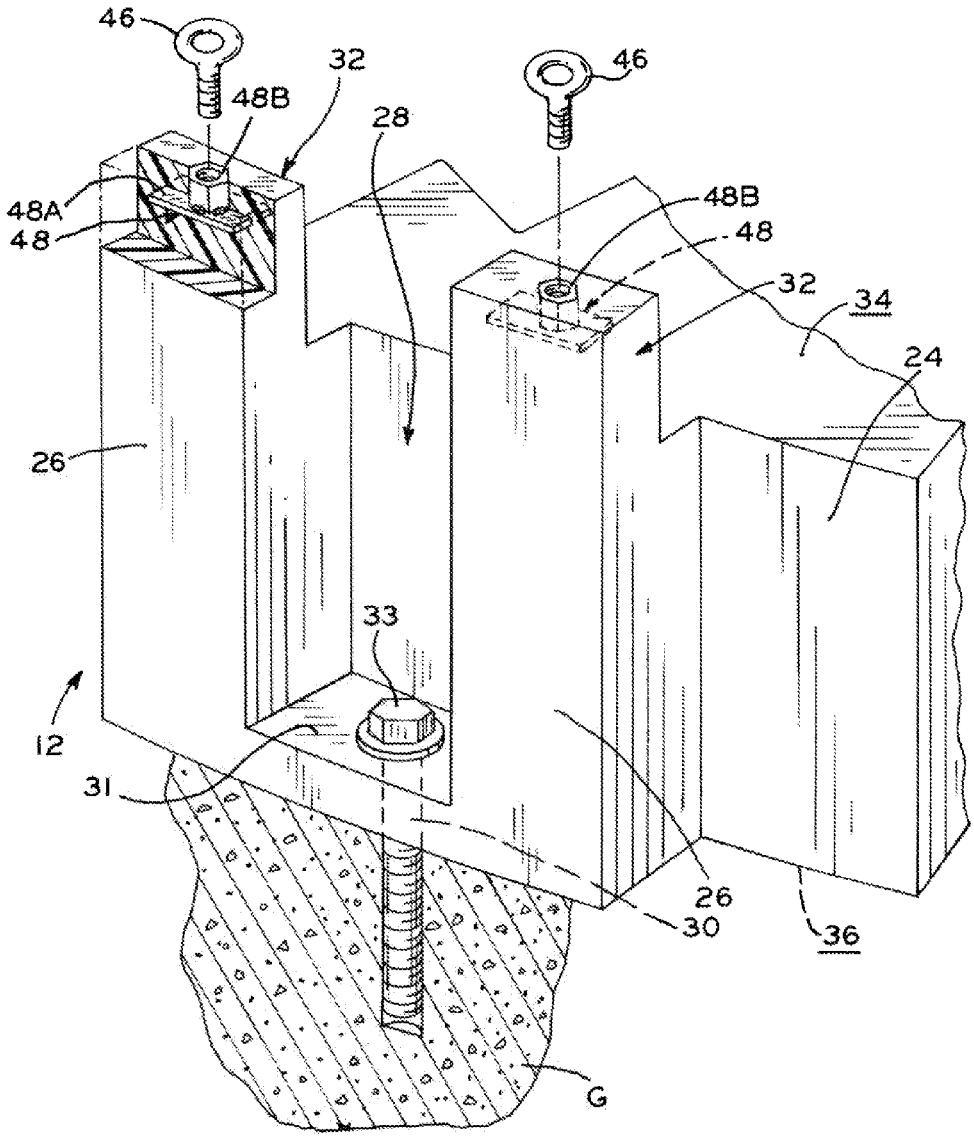
FIG. 8 is a partial perspective, partial section view of a modular tank stand section with anchor points for seismic and wind load restraint systems.

Eye bolts 46 are firmly affixed to respective tank stand sections 12 via a molded-in anchoring assembly 48 (FIG. 8). Anchoring assembly 48 includes baseplate 48A with an internally threaded hex nut 48B fixed (i.e., welded) thereto. Anchoring assembly is embedded into the material of column 26 (and, more particularly, of lip 32), such that only the threaded opening to nut 48B is exposed at the top of lip 32. Eye bolt 46 threads into nut 48B via this exposed opening to affix eye bolt 46 to anchoring assembly 48.

With cables 44 thus attached, turnbuckles 56 can be used to effectively shorten each of cables 44, placing cables 44 under tension and thereby vertically securing bulk storage container 50 to modular tank stand 10. As illustrated in FIG. 8, baseplates 48A are oriented to offer maximum resistance to the pull forces generated when cable 44 is placed under tension, both from tightening cables 44 and from wind loads on container 50. Thus, both modular tank stand 10 and bulk storage container 50 are fully constrained against motion, in that fasteners 33 and lip 32 cooperate to prevent any sliding motions (as discussed above) and cables 44 prevent any vertical motion of container 50.

Turning now to FIG. 10A, another embodiment of a wind-load restrain system is shown. Rather than cables 44 extending over the top of container 50, as discussed above, cables 44' extend only up the sides of container 50 and connect to upper anchors 58. Upper anchors may be integrally, monolithically molded as part of bulk storage container 50 (such as by rotational molding), or may be attached separately. In an exemplary embodiment, shown in FIG. 10B, anchors 58 are bolted to bulk storage container 50 with fasteners 60. Cables 44' are otherwise operated similarly, with cables 44 attached at the bottom end to eye bolts 46 and turnbuckles 56 used to cinch cables 44' to secure container 50 to modular tank stand 10.

It is contemplated that any number of cables 44, 44' may be used to secure container 50 to modular tank stand 10. Although two cables 44 are shown in FIG. 9 and three cables 44' are shown in FIG. 10A for simplicity, every radial section 12 includes anchoring assembly 48 and can therefore potentially provide an anchor point for cables 44, 44'.

3. Properties of the Modular Tank Stand

Modular tank stands in accordance with the present disclosure have weight bearing thresholds high enough to support the weight of a fully filled bulk storage container, including during application of dynamic loads (such as seismic activity, for example). Despite this high weight capacity, the tank stand sections are lightweight and small enough to facilitate transport and storage of the sections of a disassembled modular tank stand. In one exemplary embodiment, described in detail in the "Example" section below, modular tank stand 10 is capable of supporting bulk storage container 50 having a base diameter of about 10 feet and weighing in excess of 150,000 lbs. Tank stand sections 12 have a weight of about 70 lbs, for a total weight of modular tank stand 10, which has eighteen (18) tank stand sections 12, of 1260 lbs. Each tank stand section 12 also has an overall length of just over 5 feet. The small size and light weight of tank stand sections 12 make assembly, disassembly and relocation of modular tank stand 10 possible for two unassisted workers or one worker assisted by light-duty handling equipment.

Referring to FIG. 5, tank stand sections 12 define vertical height H between container support surface 34 and ground contact surface 36, which amply elevates container 50 to facilitate the use of bottom-mounted drain structures. In an exemplary embodiment, height H is twelve (12) inches, which elevates container 50 sufficiently to allow a pump (not shown) to be positioned below the bottom of container 50, thereby ensuring adequate head for the pump inlet even when container 50 is nearly empty. Further, elevation of the bottom of container 50 protects a full-drain outlet from contacting the ground, even where the full-drain outlet includes structures that extend past the bottom surface of container 50. One exemplary full-drain outlet assembly which can be beneficially paired with modular tank stand 10 is described in U.S. Provisional Patent Application Ser. No. 61/323,146, entitled METAL INSERT FITTING FOR POLYETHYLENE TANKS and filed Apr. 12, 2010, the entire disclosure of which is hereby incorporated herein by reference.

Advantageously, the vertical orientation of walls 16, 20, 23, 24 provides a high level of vertical structural support for bulk storage container 50. The assembly of tank stand sections 12 in modular tank stand 10 positions lobe walls 16 adjacent or abutting cavity walls 20, effectively doubling the thickness of the support column provided by individual walls 16, 20. This "double wall" configuration further enhances the vertical support capabilities of modular tank stand 10. Further, the "interconnecting" functionality of lobes 14 and cavities 18 prevents tank stand sections from splaying or separating under the pressure of a loaded storage container 50, so that the aggregated support surface comprised of surfaces 34 retains its original shape and form.

Also advantageously, the arcuate bends and angles create a corrugated profile in walls 16, 20, 23, 24, which provides superior lateral support and prevents shear forces from folding, buckling or otherwise toppling any of the walls. A straight wall which resists shear force resistance in two directions, namely along the longitudinal extent of the wall, but offers little shear force resistance in other directions; hence, an otherwise unsupported straight wall is easily toppled. By contrast, the bends formed in walls 16, 20, 23, 24 provide stability and shear force resistance in all directions, so that tank stand sections 12 are capable of absorbing the dynamic forces associated with forces exerted on bulk storage container 50 while it is supported by modular tank stand 10.

In addition, the "interconnected" or "interleaved" nature of lobes 14 and cavities 18 provide resistance to any lateral movement that may be urged by the weight of container 50, such as radial outward shifting of tank stand sections 12 or the opening of gaps between adjacent tank stand sections 12. Because tank stand sections 12 are laterally interconnected with one another, none of tank stand sections 12 can be "pulled out" from modular tank stand 10 or otherwise laterally moved with respect to one another. Rather, removal of any of tank stand sections 12 requires that it be vertically lifted away, as discussed above, but such vertical movement is obstructed and/or resisted by the presence and weight of container 50 and its contents. The weight of container 50, which might otherwise tend to urge separation of tank stand sections 12 from modular tank stand 10, instead contributes to the stability of the assembly, such that modular tank stand 10 remains reliably unitary whole while in service. As demonstrated in the Example below, the lateral interconnecting of tank stand sections 12, augmented by an applied weight to container support surfaces 34, imbues tank stand 10 with exceptional strength and stability.

In addition, the "wedge" or radial shape of tank stand sections 12 ensure that the amount of wall support per unit area of the container support surfaces 34, or "wall density," continuously increases from the perimeter walls 24 to the center wall 22. Advantageously, this steady increase in wall density toward the center of modular tank stand 10 corresponds with a potential increase in pressure arising from the weight of bulk storage container 50 and its contents. Some exemplary embodiments of container 50 are made of a semi-rigid material, such as polyethylene. In certain conditions, such as a high vapor pressure within container 50, the semi-rigid material may develop a slight "bulge" in the bottom surface of container 50. Such a bulge typically occurs toward the center of container 50, and may result in increased pressure near the center of modular tank stand 10, where a high wall density is available to support the additional pressure.

Also advantageously, lips 32 formed in perimeter wall columns 26 prevent bulk storage container 50 from sliding relative to modular tank stand 10. Moreover, the resistance of tank stand 10 to shear forces provided by walls 16, 20, 23, 24 cooperates with the resistance to shift of bulk storage container 50 provided by lip 32 to make modular tank stand 10 a suitable support structure for bulk storage container 50 when dynamic or vibration forces are applied, such as forces due to seismic activity. That is to say, in addition to the ability of modular tank stand 10 to withstand large amounts of weight placed upon container support surfaces 34, modular tank stand 10 is also capable of withstanding the dynamic forces associated with acceleration of bulk storage container 50 arising from shifting or movement of bulk container 50. Such acceleration forces may arise from seismic activity or wind loads, for example, as described in detail above.

Tank stand sections 12 may be made from a variety of materials, such as polymeric materials. In one exemplary embodiment, tank stand sections 12 are made of rotationally-molded polyethylene. Advantageously, polyethylene resists degradation from chemical and/or petroleum exposure, such as from chemicals or petroleum products which may be contained by container 50. Thus, the dripping or spillage of flowable materials from container 50 will not compromise the structural integrity or longevity of modular tank stand 10. Polyethylene is also suitable for corrosive environments, such as near saltwater or exposed to ultraviolet light from the sun. Yet a further advantage of polymers generally is that they can be made in a variety of different colors, which may be used to distinguish between materials contained in respective bulk storage containers 50 mounted to tank stand 10. Still a further advantage of polyethylene is that the durometer range of polyethylene materials represents a good compromise between impact resistance (a quality typically associated with low-durometer, softer materials) and strength (a quality typically associated with higher-durometer, harder materials).

Other polymeric materials suitable for use with the present disclosure include polyvinyl chloride (PVC), polypropylene, and polyvinylidene fluoride (PVDF) such as Kynar (Kynar is a registered trademark of Pennsalt Chemicals Corporation of Philadelphia, Pa.). Moreover, the above-mentioned polymeric materials are particularly suitable for rotational molding processes. It is contemplated that other materials may be used in conjunction with other manufacturing techniques.

The overall size of modular tank stand 10 may be made larger or smaller to accommodate different sizes of bulk storage container 50. For example, a modular tank stand made in accordance with the present disclosure may have an overall support surface diameter of between about 8 feet and about 12 feet for many industrial applications, or may have any other size as required or desired for a particular application.

Moreover, a modular tank stand in accordance with the present disclosure may have a container support surface with any profile, such as square, rectangular, polygonal, or the like, to accommodate bulk storage containers having a variety of footprints. Further, the tank stand sections may take other forms, such as squares, rectangles, or the like. For example, the tank stand sections may have a variety of modular "puzzle piece" configurations which can be assembled into a variety of differently-shaped container support surfaces.

EXAMPLE

In this Example, a force of 307,000 lbs (307 kip) was applied to the container support surface of an assembled modular tank stand 10, and various vertical and lateral deflections were measured under load. No failure occurred, no visual signs of distortion were present, and measured deflections at maximum load were less than 0.063 inches.

Modular tank stand 10 was constructed and assembled as discussed above. In this Example, modular tank stand 10 has a container support surface diameter of about 121⅞ inches and an overall diameter of about 126 inches. The container support surface is elevated about 12 inches above the underlying tank stand support surface (in this case, the ground). Eighteen tank stand sections were used, each having a tank stand section angle Θ of approximately 20 degrees, as shown in the figures and described in detail above. Tank stand sections 12 are made of polyethylene material, and the thickness of walls 16, 20, 23, 24 are all approximately 0.75 inches. The overall length of each tank stand section 12 is about 60⅞ inches.

Testing was conducted using two 200 kip servo hydraulic actuators, which engaged a load distribution fixture placed on the container support surface. The load distribution fixture comprised a 54-inch-by-90-inch steel plate set on top of a 10-foot diameter circular wooden plate covering the entire container support surface. The servo hydraulic actuators were 72 inches apart, with modular tank stand 10 centered beneath the actuators. Linear variable differential transformers were used to measure downward deflections of two of container support surfaces 34 and outward or radial deflections of three of perimeter walls 24 within gaps 28. Each of the tested perimeter walls 24 was separated approximately 120 degrees from the others, i.e., the testing points of radial walls 24 were evenly distributed about the periphery of modular tank stand 10.

Modular tank stand 10 was loaded in compression (i.e., downward force was applied) at a rate of 7 kip/min to a maximum load of 307 kip. Visual inspections of modular tank stand 10 and sensor displacement measurements were performed when loads of 70 kip, 150 kip, 233 kip and 307 kip were achieved. The maximum load of 307 kip was maintained for 8 hours and 45 minutes before releasing the load to 5.231 kip. In service, modular tank stand 10 is sized to support container 50 having a capacity of 8,400 gallons of material for a total supported weight of up to 153,000 lbs (153 kip). Thus, modular tank stand 10 was subjected to a sustained load of approximately double its maximum anticipated service load of 27 lbs. per square inch of container support surface area.

Vertical deflection of one of container support surfaces 34 was 0.052 inches at the maximum load of 307 kip, and increased to 0.061 inches after the 307 kip load was sustained for 8 hours, 45 minutes. Vertical deflection of the other of container support surface 34, which was opposite the first support surface, was less than 0.003 inches throughout the testing.

Radial deflection of a first perimeter wall 24 was 0.048 inches at the maximum load of 307 kip, and increased to 0.052 inches after the 307 kip load was sustained for 8 hours, 45 minutes. Radial deflection of a second perimeter wall 24 was 0.004 inches at the maximum load of 307 kip, and increased to 0.006 inches after the 307 kip load was sustained for 8 hours, 45 minutes. Radial deflection of a third perimeter wall 24 was 0.028 inches at the maximum load of 307 kip, and increased to 0.029 inches after the 307 kip load was sustained for 8 hours, 45 minutes.

This Example shows that minimal material deflection occurs within modular tank stand 10, even with a load that is double the expected service load imparted by a typical bulk storage container. Thus, modular tank stand 10 is expected to be a suitable replacement for standard concrete or steel platforms currently in use.

While this invention has been described as having an exemplary design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A modular tank stand assembled from a plurality of connectable tank stand sections, the modular tank stand comprising:

a first tank stand section comprising:

a first lower surface abutting a tank stand support surface;

a first container support surface spaced vertically from said first surface;

a first wall monolithically formed with at least a portion of said first lower surface and said first container support surface, said first wall extending from said first lower surface to said first container support surface, said first wall extending substantially entirely around a periphery of at least one of said first lower surface and said first container support surface;

at least one lobe formed as part of said first wall; and a second tank stand section comprising:

a second lower surface abutting the tank stand support surface;

a second container support surface spaced vertically from said second lower surface; and a second wall monolithically formed with at least a portion of said second lower surface and said second container support surface, said second wall extending from said second lower surface to said second container support surface, said second wall extending substantially entirely around a periphery of at least one of said second lower surface and said second container support surface; and at least one cavity formed protruding into said second wall, said cavity sized to receive said lobe along a vertical direction of insertion, said lobe and said cavity cooperating to restrain lateral movement of said first tank stand section with respect to said second tank stand section, while allowing vertical movement of said first tank stand section with respect to said second tank stand section, said first and second walls each comprising:

a center wall;

a perimeter wall opposite said center wall;

a first side wall extending between said center wall and said perimeter wall; and a second side wall extending between said center wall and said perimeter wall and defining an acute angle with said first side wall, such that said first side wall and said second side wall converge toward said center wall and diverge toward said perimeter wall, and wherein said first and second tank stand sections are each generally wedge-shaped;

the modular tank stand in combination with a bulk storage container disposed on said first container support surface and said second container support surface such that said bulk storage container is supported by each of said first and second container support surfaces and is supported directly through said first and second walls and said first and second lower surfaces of said tank stand sections.

2. The modular tank stand of claim 1, wherein said lobe is unitarily formed with said first tank stand section.

3. The modular tank stand of claim 1, wherein:

said lobe defines a lateral lobe width, that increases as said lobe extends outwardly away from said first wall, and said cavity defines a lateral cavity width that increases as said cavity extends inwardly away from said second wall, whereby the increases in said lobe width cooperate with the increases in said cavity width to laterally interconnect said first tank stand section and said second tank stand section, while allowing said vertical movement of said first tank stand section with respect to said second tank stand section.

4. The modular tank stand of claim 1, further comprising:

a lip extending upwardly from at least one of said first container support surface and said second container support surface, said lip disposed at a periphery of one of said first wall and said second wall respectively; and an anchoring assembly fixed to said lip, said anchoring assembly connectable to a cable.

5. The modular tank stand of claim 1, wherein said first and second walls are normal to said first and second container support surfaces, respectively, whereby said first and second walls are vertically oriented.

6. The modular tank stand of claim 1, wherein at least one of said first tank stand section and said second tank stand section is formed of a polymer.

7. The modular tank stand of claim 6, wherein said polymer comprises rotationally molded polyethylene.

8. The modular tank stand assembly of claim 1, wherein said first tank stand section is substantially identical to said second tank stand section.

9. The modular tank stand assembly of claim 1, wherein said first lower surface, said first container support surface, and said first wall form a first sealed enclosure.

10. The modular tank stand assembly of claim 9, wherein said first sealed enclosure comprises a single hollow cavity.

11. The modular tank stand assembly of claim 9, wherein said second lower surface, said second container support surface, and said second wall form a second sealed enclosure.

12. The modular tank stand assembly of claim 11, wherein said second sealed enclosure comprises a single hollow cavity.

13. The modular tank stand of claim 1, wherein said first tank stand section and said second tank stand section each comprise rotationally-molded monolithic structures having a substantially uniform material thickness.

14. The modular tank stand of claim 1, wherein said first tank stand section and said second tank stand section each comprise rigid polymer structures.

15. The modular tank stand of claim 1, wherein said first and second container support surfaces cooperate to form a conical surface.

16. A modular tank stand assembled from a plurality of connectable tank stand sections, the modular tank stand comprising:

a first tank stand section comprising:

a first lower surface;

a first container support surface spaced vertically from said first lower surface;

a first wall monolithically formed with at least a portion of said first lower surface and said first container support surface, said first wall extending from said first lower surface to said first container support surface, said first wall extending substantially entirely around a periphery of at least one of said first lower surface and said first container support surface such that a substantially sealed, single hollow cavity is defined within said periphery and between said first container support surface and said first lower surface;

at least one lobe formed as part of said first wall; and a second tank stand section comprising:

a second lower surface;

a second container support surface spaced vertically from said second lower surface; and a second wall monolithically formed with at least a portion of said second lower surface and said second container support surface, said second wall extending from said second lower surface to said second container support surface, said second wall extending substantially entirely around a periphery of at least one of said second lower surface and said second container support surface such that a substantially sealed, single hollow cavity is defined within said periphery and between said second container support surface and said second lower surface; and at least one cavity formed protruding into said second wall, said cavity sized to receive said lobe along a vertical direction of insertion, said lobe and said cavity configurable between a connected state and a disconnected state, said lobe and said cavity both vertically movable along the vertical direction of insertion and laterally inseparable relative to one another when said lobe and said cavity are in said connected state, wherein said first tank stand section and said second tank stand section each comprise rigid polymer structures, and the modular tank stand in combination with a bulk storage container disposed on said first container support surface and said second container support surface such that said bulk storage container is supported by each of said first and second container support surfaces and is supported directly through said first and second walls and said first and second lower surfaces of said tank stand sections.

17. The modular tank stand assembly of claim 16, wherein said first tank stand section is substantially identical to said second tank stand section.

18. The modular tank stand assembly of claim 16, wherein said lobe is configured to be vertically lowered into said cavity in order to transition said lobe and said cavity from said disconnected state to said connected state, and wherein said lobe is configured to be vertically lifted away from said cavity in order to transition said lobe and said cavity from said connected state to said disconnected state.

19. The modular tank stand assembly of claim 16, wherein said lobe defines a lobe width that expands as said lobe extends away from said first wall, and said cavity defines a corresponding cavity width that expands as said cavity extends away from said second wall, such that said lobe laterally interconnects with said cavity when said lobe and said cavity are in said connected state.

20. The modular tank stand of claim 16, in combination with a bulk storage container disposed on said first container support surface and said second container support surface such that said bulk storage container is supported by each of said first container support surface and said second container support surface when said lobe and said cavity are in said connected state.

21. The modular tank stand of claim 16, wherein said first tank stand section and said second tank stand section each comprise rotationally-molded monolithic structures having a substantially uniform material thickness.

22. The modular tank stand of claim 16, wherein said first and second container support surfaces cooperate to form a conical surface.

23. A modular tank stand comprising:

a plurality of tank stand sections interconnectable with one another into a tank stand assembly, the tank stand assembly defining an exterior perimeter around an aggregated container support surface, each tank stand section comprising:

a lower surface;

a container support surface spaced vertically from said lower surface and forming a respective portion of said aggregated container support surface;

a wall extending from said lower surface to said container support surface, said wall comprising a center wall, a perimeter wall opposite said center wall, a first side wall extending between said center wall and said perimeter wall, and a second side wall extending between said center wall and said perimeter wall, said wall bounding an internal cavity;

at least one lobe formed as part of said first side wall;

at least one cavity formed protruding into said second side wall;

said exterior perimeter defined by said perimeter walls of said plurality of tank stand sections when said plurality of tank stand sections are interconnected; and said center walls of said plurality of tank stand sections adjacent to one another at a central portion of the aggregated container support surface when said plurality of tank stand sections are interconnected, such that said walls of said plurality of tank stand sections provide increasing wall support per unit area of the aggregated container support surface from said exterior perimeter toward said central portion;

said plurality of tank stand sections each being generally wedge-shaped, such that said first and second side walls of each of said plurality of tank stand sections converge toward a tip at said center wall and diverge toward said perimeter wall, whereby the amount of wall support per unit area of the container support surface continuously increases from respective perimeter walls toward respective center walls when said plurality of tank stand sections are interconnected.

24. The modular tank stand of claim 23, wherein said plurality of tank stand sections are substantially identical to one another, such that each of said plurality of tank stand sections is interconnectable with each other of said plurality of tank stand sections to form said tank stand assembly.

25. The modular tank stand of claim 24, wherein said lower surface, said container support surface and said wall cooperate to form a sealed enclosure for each of said plurality of tank stand sections.

26. The modular tank stand of claim 23, wherein each said wall defines a vertical tank stand section height extending from said lower surface to each said container support surface, each said wall extending substantially entirely around a periphery of at least one of each said lower surface and each said container support surface.

27. The modular tank stand of claim 23, in combination with a bulk storage container disposed on said an aggregated container support surface.

28. The modular tank stand of claim 23, wherein said plurality of tank stand sections each comprise rotationally-molded monolithic structures having a substantially uniform material thickness.

29. The modular tank stand of claim 23, wherein said plurality of tank stand sections each comprise rigid polymer structures.

30. The modular tank stand of claim 23, wherein said container support surfaces of said plurality of tank stand sections cooperate to form a conical surface.

* * * * *